United States Patent [19]

Meimeteas

[11] Patent Number: 4,887,327

[45] Date of Patent: Dec. 19, 1989

[54] PAINT BRUSH FERRULE COVER

[76] Inventor: Angelo Meimeteas, 80 Getrude St., Lynn, Mass. 01902

[21] Appl. No.: 324,198

[22] Filed: Mar. 16, 1989

Related U.S. Application Data

[63] Continuation-in-part of Ser. No. 127,467, Dec. 12, 1987, Pat. No. 4,821,361, which is a continuation-in-part of Ser. No. 85,362, Aug. 14, 1987, Pat. No. 4,751,762.

[51] Int. Cl.[4] ..... A46B 17/00; A46B 17/02

[52] U.S. Cl. ..... 15/246; 15/168; 15/192; 15/DIG. 4

[58] Field of Search ..... 15/248 R, DIG. 4, 246, 15/247, 168, 169, 170, 175, 143 R, 192–194, 184, 174; 206/361; 16/110 R, DIG. 18, DIG. 19

[56] References Cited

U.S. PATENT DOCUMENTS 2,309,990 2/1943 Savi ..... 15/174
3,231,919 2/1966 MacDonald ..... 15/DIG. 4

FOREIGN PATENT DOCUMENTS 497801 12/1950 Belgium ..... 15/168
358689 10/1931 United Kingdom ..... 15/248 R

*Primary Examiner*—Peter Feldman
*Attorney, Agent, or Firm*—Paul J. Cook

[57] ABSTRACT

A two piece cover for the ferrule of a paint brush is provided which is formed from a rubber composition and includes (a) a cover ferrule section having a hose (b) and a hook which is intergrally formed with a plate. The hook extends through a hole in the cover ferrule section. The hook permits a paint brush to be hung onto the edge of a container of paint or paint thinner.

2 Claims, 1 Drawing Sheet

PAINT BRUSH FERRULE COVER

REFERENCE TO RELATED APPPLICATIONS

This application is a continuation-in-part of copending application Ser. No. 127,467, filed Dec. 12, 1987, now U.S. Pat. No. 4,821,361 which, in turn is a continuation-in-part of application Ser. No. 085,362, filed Aug. 14, 1987, issued June 21, 1988 as U.S. Pat. No. 4,751,762.

BACKGROUND OF THE INVENTION

This invention relates to a paint brush ferrule cover and more specifically to a paint brush ferrule cover adapted to protect the ferrule from contact with paint or paint thinner which cover is provided with a hook to hang the brush in a container of paint or paint thinner.

Generally, a paint brush is formed from bristles, a bristle mounting, a metal ferrule which covers the bristle mounting and a handle which is attached to or comprises a one piece construction with the bristle mounting. After a paint brush is used. it is washed in a thinner such as water or mineral spirits and then is reused. It is common practice to insert a nail into the wooden portion of the handle adjacent the ferrule and to bend the nail so that the brush can be hung on the lip of a container containing the thinner or paint when the brush is not in use.

It has been propsed in U.S. Pat. No. 1,130,759 to utilize a metal paint brush cover which is fit around the paint brush handle adjacent the ferrule portion of the brush. The cover is not fit to contact the entire ferrule but is shaped in the form of a cup whereby a space is formed between the cover and the ferrule in order to retain excess paint or thinner which may have been accepted by the brush. The cover is provided with a hook so that the paint brush can be hung from the edge of a container for paint or thinner. Since the paint brush handle is not a precisionally made component, the variation in size and shape of a paint brush handle for a given standard size paint brush will vary. Given this fact and the fact that a paint brush cover is made of a metal which is relatively inflexible, leakages will occur from the volume within the paint brush cover onto the handle which will cause caking of paint on the handle. This is undesirable since it makes the brush heavier due to the cumulative effect of caking paint and since the brush is used for different colored paint, colors from the paint on the handle will be deposited during subsequent use with a different colored paint. The problem of leakage is particularly acute with thinner since thinner is a far less viscous liquid than paint. The thinner will accumulate in the space between the bristle holder and the ferrule by being passed into the space by capillary action when the paint brush is hung into the thinner. Thus, when the position of the brush is reversed so that the brush is positioned above the handle, the thinner will leak past the ferrule onto the handle and will not be stopped by the cover since the metal cover can not be precisely fit onto the handle portion adjacent the ferrule. Thus, inevitably, the handle will be caked with paint and the brush must be discarded.

It has been proposed in U.S. Pat. No. 2,733,471 to utilize a rubber paint brush cover which fits around the ferrule portion of the paint brush adjacent the handle. The paint brush cover is provided with fingers so that the cover is angled away from the ferrule to form a volume between the ferrule and the paint brush cover into which excess paint or paint thinner can be retained. No means are provided for positioning the paint brush on a container for paint or paint thinner.

Various brush covers are disclosed for example in U.S. Pat. Nos. 4,392; 860,527; 1,501,020; 1,720,868; 2,237,969; 2,485,068; 2,958,087; 3,106,738; 3,193,863; 3,968,950 and 4,001,909.

It would be desirable to provide a paint brush ferrule cover which prevents excess thinner or paint retained by the brush from spilling onto the user during use of the paint brush and which permits the brush to be positioned on a container for paint or paint thinner. Furthermore, it would be desirable to provide such a brush which does not interfere with the conventional use of the brush or whih actually improves the conventional use of the brush.

SUMMARY OF THE INVENTION

In accordance with this invention, a hollow flexible rubber cover for a paint brush ferrule is provided which fits over the ferrule section of the brush and is formed from two pieces; a rubber cover piece and a hook formed integrally with a rigid plate. The cover is hollow and has an opening of a size so that the handle and ferrule section of the brush can fit into the cover and so that the cover portion surrounding an opening for the cover fits tightly about the ferrule section of the brush so as prevent liquid from entering the interior of the cover. The cover is formed from a stretchable flexible rubber composition. By "rubber" as used herein is meant compositions formed from natural rubber or synthetic plastics or rubbers which are stretchable and which may or may not contain additives such as fillers or pigments. The hook and plate piece is positioned such that the hook extends through a small opening in the cover and the plate is positioned between the ferrule and the cover. The cover, hook and plate form a liquid tight seal. When the cover hook and plate are in place on the paint brush, the paint brush by means of the hook can be hung on the lip of a container for paint or paint thinner.

DESCRIPTION OF SPECIFIC EMBODIMENTS

Figure 2:
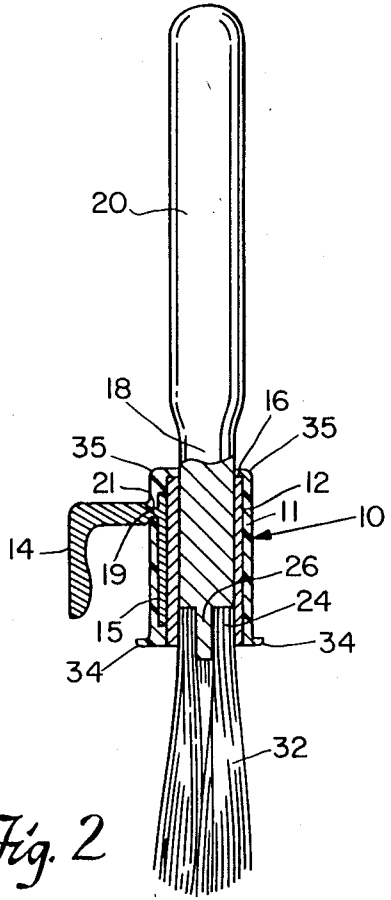
FIG. 2 is a longitudinal cross-sectional view of the cover and brush of FIG. 1 when the cover hook and plate are in place over the brush ferrule.
Figure 1:
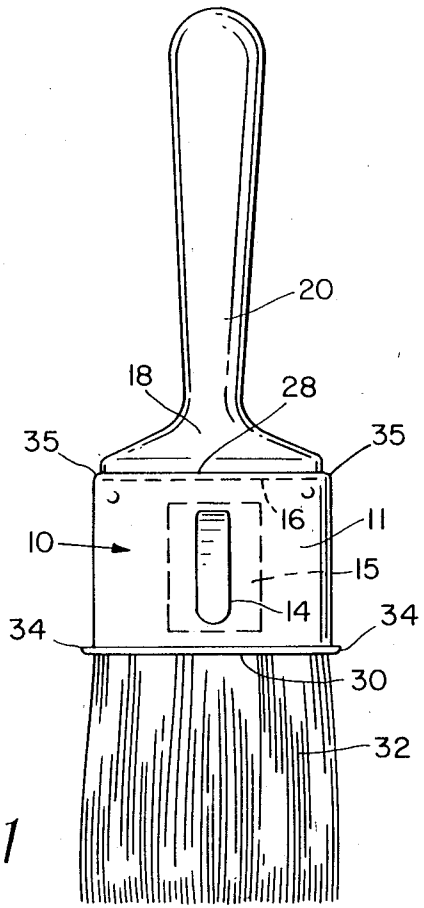
FIG. 1 is top view showing the cover of this invention and its relationship to a paint brush.

The ferrule cover of this invention comprises a cover formed from a flexible stretchable rubber composition such as natural latex or synthetic polymers including polyvinylchloride or the like which may or may not contain additives such as fillers, dyes or pigments and a second piece comprising a hook formed integrally with a plate. The cover can be formed by any conventional means such as injection molding or dipping or spraying on a male form. The plate is positioned between the ferrule and the cover while the hook extends through a small opening in the cover. The cover, hook and plate form a liquid-tight seal. The cover is sufficiently large so as to minimize twisting of the hook away from the ferrule while the brush is hanging in a container. Generally, the cover is at least 1.25 inches wide. The cover can have reduced flexibility by adding filler to the rubber. It is preferred that the cover be positioned over the ferrule edge adjacent the handle to prevent leakage of paint or thinner from the interior of the brush onto the handle.

Referring to the figures, the paint brush ferrule cover 10 comprises a cover formed as a closed rubber ring 11 which fits tightly about the circumference of the ferrule 12. A second piece is provided which comprises a hook 14 formed integrally with a rigid plate 15. The hook and plate are formed from a rigid material such as a rigic plastic composition or a metal composition. The cover 11 is adapted to fit over the ferrule edge 16 adjacent the brush neck section 18 which is connected to handle 20 in order to prevent leakage of paint or thinner from the bristles 24 in bristle mounting section 26 through edge 16 onto handle 20. The width of the cover 11 from edge 28 to edge 30 should be at least 1.25 inches so that the cover is not unduly twisted when the brush is hung on the hook 14 on a container with the bristles 32. The portion 19 of the hook 14 has a smaller diameter than the hook 14. Since the cover 11 is flexible, the hook can be extended through a small opening 21 in cover 11 and a liquid tight seal is formed among the plate 15, the hook 14, the hook portion 19 and the cover 11.

The size of the cover 11 can be expanded by stretching the lips 34 and 35 so that one cover 11 can accommodate more than one size brush. Typical brush size are those having a width across the ferrule of 1 inch, 2 inches, 2½ inches, 3 inches, 4 inches, 5 inches or 6 inches or larger. The hook is positioned through the cover 11 before the cover 11 is positioned on the ferrule 12.

The ferrule cover of this invention provides substantial advantages over the prior art. The ferrule cover of this invention eliminates the use of nails that are presently commonly used and therefore does not damage the brush. The cover of this invention protects the handle of the paint brush and therefore extends the life of the paint brush since it minimizes paint from accumulating on the handle. Any paint which may accumulate on the cover can be removed easily since the cover is flexible. Thus, by deforming the cover after removing it from the paint brush, any accumulated paint thereon will crack and can be easily removed manually. Even flexible latex paint or partially dried paint can be removed from the cover easily by deforming it and then peeling the accumulated flexible paint therefrom. The hook permits hanging the paint brush onto the edge of a container for the paint or thinner and therefore promotes ease of use. Even when the cover and paint brush are hung in a thinner, any thinner which accumulates in the bristle mounting section beneath the ferrule will not run onto the user when the paint brush is inverted since any thinner will not pass edge 28 due to the tight fit of the cover 11 over the ferrule edge 16. Thus, the cover of this invention greatly extends the useful life of a paint brush.

I claim:

1. A hollow flexible rubber cover for a paint brush having a handle section, a bristle mounting section attached to said handle section, a ferrule surrounding said bristle mounting section and a bristle brush secured between said bristle mounting section and said ferrule which comprises a flexible cover being shaped to make a tight contact fit with the entire ferrule, said cover having a first opening of a size to permit insertion of a paint brush into said cover and to seal the interior of said cover against the ferrule to prevent liquid from entering said interior and a hook formed integrally with a rigid plate, said hook extending through a second small opening in said cover in a direction toward said bristles, said cover forming a liquid tight seal with said hook and said plate.

2. The cover of claim 1 including a lip positioned around said opening, said lip being formed integrally with said cover.

* * * * *